US007332983B2

(12) United States Patent
Larson

(10) Patent No.: US 7,332,983 B2
(45) Date of Patent: Feb. 19, 2008

(54) TUNABLE DELAY LINE USING SELECTIVELY CONNECTED GROUNDING MEANS

(75) Inventor: Thane Michael Larson, Roseville, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 11/263,339

(22) Filed: Oct. 31, 2005

(65) Prior Publication Data

US 2007/0096848 A1 May 3, 2007

(51) Int. Cl.
*H01P 1/18* (2006.01)

(52) U.S. Cl. ..... 333/161; 333/156

(58) Field of Classification Search ..... 333/156, 333/161

See application file for complete search history.

(56) References Cited

U.S. PATENT DOCUMENTS

| | | | | |
|---|---|---|---|---|
| 4,603,301 | A | 7/1986 | Dukes et al. | |
| 4,633,308 | A | 12/1986 | Dukes et al. | |
| 4,638,191 | A | 1/1987 | Baumgartner et al. | |
| 4,642,588 | A | 2/1987 | Kameya | |
| 4,658,225 | A | 4/1987 | Dukes et al. | |
| 4,700,573 | A | 10/1987 | Savord | |
| 4,703,251 | A | 10/1987 | Baumgartner et al. | |
| 4,914,407 | A * | 4/1990 | Itoh | 333/161 |
| 5,083,100 | A | 1/1992 | Hawkins et al. | |
| 5,157,277 | A | 10/1992 | Tran et al. | |
| 5,187,455 | A | 2/1993 | Mandai et al. | |
| 5,208,213 | A | 5/1993 | Ruby | |
| 5,243,227 | A | 9/1993 | Gutierrez, Jr. et al. | |
| 5,420,531 | A | 5/1995 | Wetlaufer | |
| 5,481,232 | A * | 1/1996 | Wu et al. | 333/161 |
| 5,801,601 | A | 9/1998 | Gayle | |
| 5,900,762 | A | 5/1999 | Ramakrishnan | |
| 6,127,869 | A | 10/2000 | Hirasaka | |
| 6,127,871 | A | 10/2000 | Moll | |
| 6,879,289 | B2 * | 4/2005 | Hayes | 343/700 MS |
| 7,012,482 | B2 * | 3/2006 | Rawnick et al. | 333/156 |
| 2004/0155728 | A1 * | 8/2004 | Cheung et al. | 333/161 |

FOREIGN PATENT DOCUMENTS

| | | |
|---|---|---|
| EP | 1 058 337 A2 | 12/2000 |
| GB | 1438470 | 6/1976 |

* cited by examiner

*Primary Examiner*—Benny Lee

(57) ABSTRACT

A tunable delay line system includes a stripline and a plurality of cross-over lines. The stripline defines a propagation delay characteristic. The plurality of cross-over lines are each spaced from and extend with an orientation that is nonparallel with the stripline. Each of the plurality of cross-over lines is configured to be selectively grounded to alter the propagation delay characteristic of the stripline.

30 Claims, 4 Drawing Sheets

TUNABLE DELAY LINE USING SELECTIVELY CONNECTED GROUNDING MEANS

BACKGROUND

As systems, such as computer systems, continue to evolve, the systems operate at increasingly higher speeds. As operating speeds increase, it is generally desired that the timing control signals communicated within the system improve in accuracy. Clock signals, which are employed to synchronize signals are generally designed to reach a destination device or location at the same time. Accordingly, the propagation delay time (i.e., the time it takes for each clock signal to travel along the respective transmission line) is calculated to synchronize the arrival of the clock signals at the destination device or location. Delay lines are typically used to assist in timing the transmission of clock signals between two points without generally requiring a large amount of physical space within the system or circuit being designed.

Typical embedded delay lines are routed through the base material (e.g. fiberglass or other insulator) between two reference planes held in a constant potential, for example, at ground. In such situations, the waves or signals produced are generally transverse electromagnetic (TEM) waves and the propagation delay is generally constant along a delay line irregardless of the geometry or positioning of the delay line between the reference planes. Since the geometry and positioning of the delay line does not substantially affect the propagation delay, the propagation delay along the delay line is primarily dependent upon the length of the delay line and the base material used.

However, the implementation of a propagation delay along calculated lengths of delay lines does not always produce actual results within the tolerances of high speed systems. In addition, the propagation delay of the embedded delay lines are not typically adjustable after the initial manufacture of a system including the delay line. As a result, delay line systems are often remanufactured with adjustments being made in an iterative process based on propagation delay testing until a desired propagation delay is achieved. In some instances, this process is both time consuming and expensive. In addition, systems and electronic component parameters can change over the manufacturing life of the system product, which in some circumstance may cause clock signals to be desynchronized.

SUMMARY

One aspect of the present invention relates to a tunable delay line system including a stripline and a plurality of cross-over lines. The stripline defines a propagation delay characteristic. The plurality of cross-over lines are each spaced from and extend with an orientation that is nonparallel with the stripline. Each of the plurality of cross-over lines is configured to be selectively grounded to alter the propagation delay characteristic of the stripline.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following Detailed Description, therefore, is not to be taken in a limiting sense, and the scope of the present invention is defined by the appended claims.

According to one embodiment, a tunable, embedded delay line or stripline utilizes cross-over lines embedded between the delay line and a reference plane and configured to be selectively grounded to adjust signal delay along the delay line. In one example of this embodiment, one or more of the cross-over lines are grounded to increase the capacitance of the delay line without generally effecting the inductance of the delay line. Changing the capacitance without substantially changing the inductance alters the delay along the delay line. Consequently, the more cross-over lines that are grounded, the more the propagation delay along the delay line is adjusted. Conversely, if no cross-over lines are grounded, the cross-over lines are virtually transparent to the delay line and do not substantially affect the propagation delay. In this respect, following initial design and manufacture of a circuit board, the propagation delay can be tuned or altered to more closely match the desired timing or delay of clock signals in the circuit by grounding various numbers of the cross-over lines. Accordingly, by more closely tuning the propagation delay to match other signal speeds or clock specifications, a more reliable delay line circuit can be provided.

Figure 1:
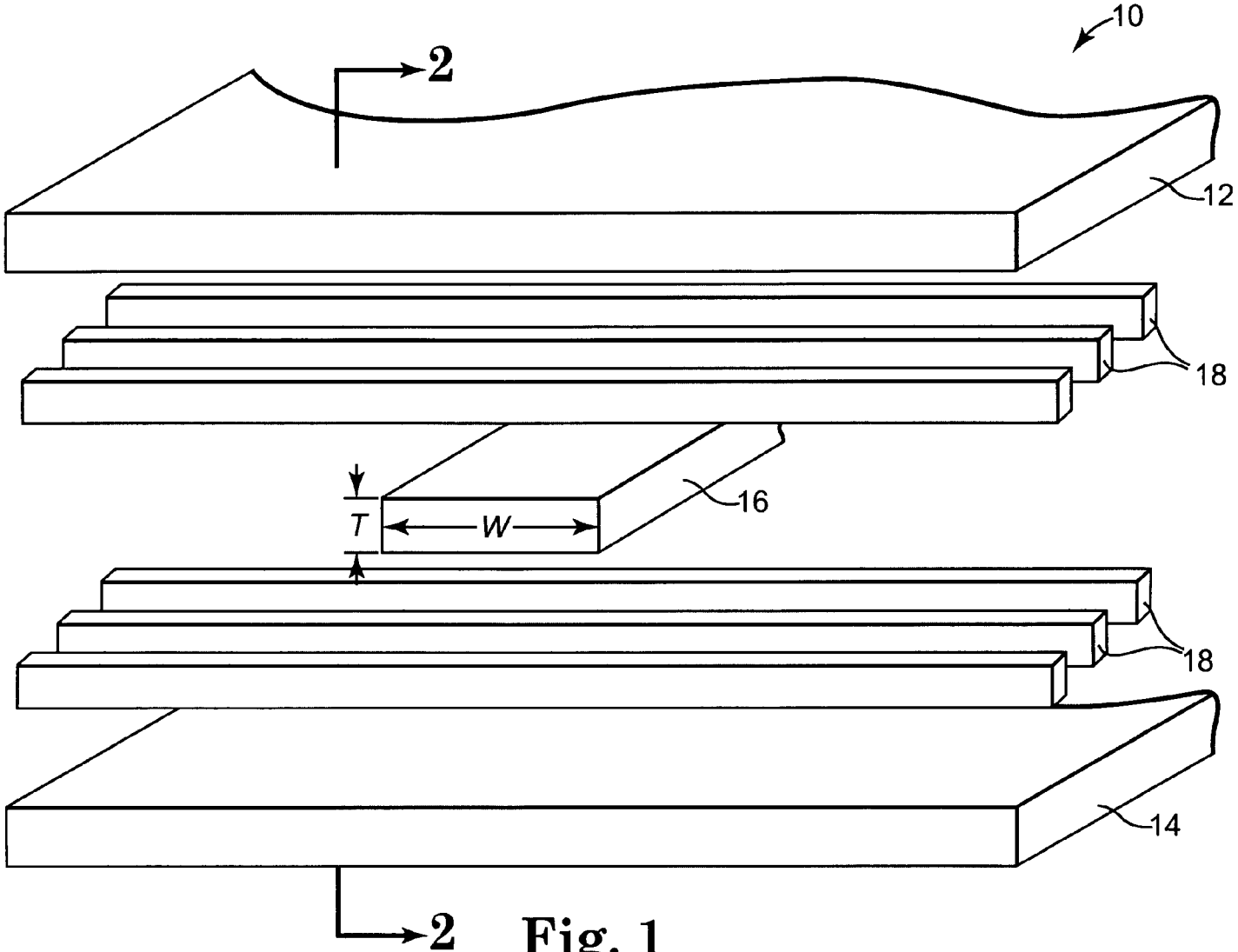
FIG. 1 is an exploded perspective view of one embodiment of a delay line system illustrated without an insulating substrate for clarity.
Figure 2:
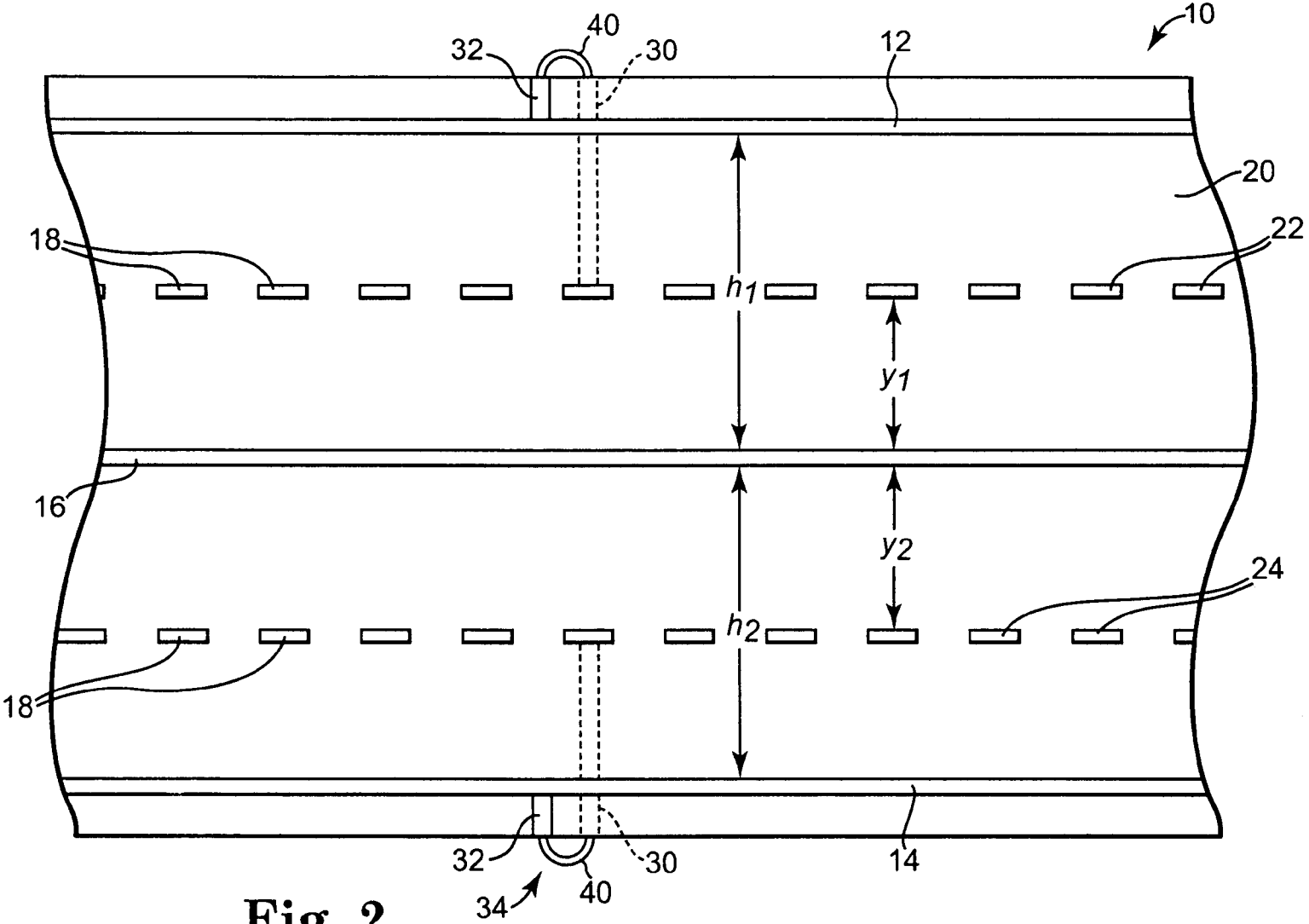
FIG. 2 is a cross-sectional view of one embodiment of the delay line system of FIG. 1 taken along the line 2-2.

Turning to the figures, FIG. 1 generally illustrates one embodiment of a delay line system 10 without an insulating substrate for clarity and FIG. 2 illustrates a cross-section view of delay line system 10. Delay line system 10 includes a first reference plane 12, a second reference plane 14, a delay line or stripline 16, a plurality of cross-over lines 18, and an insulating substrate 20 (illustrated in FIG. 2).

First and second reference planes 12 and 14 are spaced from one another, and in one embodiment, extend generally parallel to one another. Stripline 16 is an elongated trace extending between the first and second reference planes 12 and 14. Each of the plurality of cross-over lines 18 extends in a direction generally non-parallel to stripline 16 between stripline 16 and one of first and second reference planes 12 and 14. As illustrated in FIG. 2, each of first reference plane 12, second reference plane 14, stripline 16, and transverse lines 18 are substantially embedded within insulating substrate 20.

In one embodiment, first and second reference planes 12 and 14 are any suitable reference planes, such as copper plates, held to a constant potential. In one embodiment, first and second reference planes 12 and 14 are held at ground and, therefore, are otherwise referred to as first and second ground planes 12 and 14.

Stripline 16 is a suitable signal conductor, such as a trace, wire, etc., configured to facilitate signal travel. In one example, stripline 16 is a copper trace. Stripline 16 is positioned between first and second reference planes 12 and 14. More specifically, as depicted in FIG. 2, stripline 16 is positioned a distance $h_1$ from first reference plane 12 and a distance $h_2$ from second reference plane 14. In one embodiment, distance $h_1$ is equal to distance $h_2$. Other relationships between distance $h_1$ and distance $h_2$ are also contemplated. The reference planes 12 and 14 are electrostatically and magnetically coupled to stripline 16 such that reference planes 12 and 14 provide a return path for the signal current transmitted along stripline 16.

Each of the plurality of cross-over lines 18 is a wire, trace, or other suitable conductor and extends between first and second reference planes 12 and 14. In one embodiment, each cross-over line 18 extends with an orientation generally non-parallel to the extension of stripline 16. In one example of this embodiment, each cross-over line 18 extends with an orientation generally perpendicular to the extension of stripline 16 and, as such, is a transverse line 18. Although referred to throughout the remainder of the specification as transverse lines 18 for clarity, it should be understood that other non-parallel cross-over lines 18 could alternatively or additionally be utilized.

In one embodiment, as depicted in FIG. 2, the plurality of transverse lines 18 is divided into a first portion of transverse lines 22 and a second portion of transverse lines 24. First portion of transverse lines 22 are positioned between stripline 16 and first reference plane 12, and second portion of transverse lines 24 are positioned between stripline 16 and second reference plane 14. In this respect, first portion of transverse lines 22 are positioned a distance y1 from stripline 16, and second portion of transverse lines 24 are positioned a distance y2 from stripline 16. In one example, distance y1 is generally equal to distance y2. Other relationships between distances y1 and y2 are also contemplated. In one embodiment, the entire plurality of transverse lines 18 are positioned between stripline 16 and first reference plane 12. In one embodiment, the entire plurality of transverse lines 18 are positioned between stripline 16 and second reference plane 14 (notably, this configuration is not shown but will be clear to one of skill in the art upon reading this description and viewing the associated figures). The number of and spacing between transverse lines 18 is generally determined based upon the level of adjustability desired for delay line circuit 10.

Insulating substrate 20 substantially surrounds each of first reference plane 12, second reference plane 14, stripline 16, and the plurality of transverse lines 18. In one embodiment, insulating substrate 20 is formed of fiberglass, such as FR-4, or another suitable insulating substrate. In one example, as depicted in FIG. 2, a via 30 is formed through insulating substrate 20 between the outer surface of insulating substrate 20 and each transverse line 18 as generally illustrated with respect to two transverse lines 18 in FIG. 2. In one embodiment as depicted in FIG. 2, at least one via 32 is similarly formed between the outer surface of insulating substrate 20 and each reference plane 12 and 14.

In this respect, transverse lines 18 are electrically floating within insulating substrate 20 and are not initially magnetically or electrically coupled to reference planes 12 or 14 or to stripline 16. In this state, transverse lines 18 are neither electrostatically nor magnetically coupled to stripline 16. Also, floating transverse lines 18 do not substantially affect the propagation delay along stripline 16. Otherwise stated, when uncoupled from reference planes 12 or 14, transverse lines 16 are generally electrically transparent to stripline 16. In one embodiment, delay line system 10 with transparent transverse lines 18 functions similar to delay line systems that do not incorporate transverse lines 18. As such, the propagation delay along stripline 16 can be generally expressed by one of the following Equations I or II:

$$t_p=\sqrt{\mu\epsilon} \qquad \text{Equation I}$$

where $t_p$=propagation delay per unit length (i.e., the propagation delay characteristic)

$\mu$=permeability of substrate $\epsilon$=permittivity of substrate $$t_p=\sqrt{LC} \qquad \text{Equation II}$$

where $t_p$=propagation delay per unit length (i.e., the propagation delay characteristic)

L=inductance per unit length of stripline

C=capacitance per unit length of stripline

In the case of transparent transverse lines 18, the propagation delay per unit length expressed by Equation I is generally equal to the propagation delay expressed by Equation II. The delay expressed in Equation I is based solely on the properties of insulating substrate 20. Accordingly, the propagation delay per unit length tp may be directly provided by the substrate manufacturer. For example, FR4 fiberglass generally has a propagation delay tp of 180 pico seconds/inch. Equation II expresses the delay based on properties of stripline 16. However, since inductance and capacitance of stripline 16 are inversely proportional when transverse lines 18 are transparent, geometry changes to stripline 16 and its position between reference planes 12 and 14 do not generally alter the delay calculated using Equation II. As such, neither width W nor or thickness T of stripline 16 as depicted in FIG. 1 have a substantive effect on the delay calculated in either of the two equations.

In one embodiment, as depicted in FIG. 2, to adjust or tune delay along stripline 16, a connector or jumper 40 (e.g., a wire, zero ohm resister, or other suitable very low resistance solderable component) is connected to at least one transverse line 18 and a respective reference plane 12. For example, connector 40 is coupled to reference plane 12 or 14 by via 32 and to one of transverse lines 18 by via 30. In other embodiments, transverse line 18 is connected to reference plane 12 with permanent in-board connections. In one embodiment in which reference plane 12 is ground plane 12, connector 40 essentially grounds the connected transverse line 18. A grounded transverse line 18 is primarily electrostatically connected to stripline 16 with little magnetic coupling to stripline 16. Accordingly, grounded transverse lines 18 create a slotted ground plane (e.g., slotted ground plane 34 illustrated in FIG. 2) rather than the relatively smooth ground plane provided by reference plane 12 and 14.

Grounded transverse lines 18 alter the capacitance while maintaining inductance of stripline 16. In particular, capacitance is generally added to stripline 16 by placing stripline 16 in the proximity of any metal object. Conversely, inductance is generally altered by coupling wires or traces that have a parallel orientation with respect to one another. Therefore, by placing transverse lines 18 near stripline 16 where transverse lines 18 are generally perpendicular rather than parallel to stripline 16, grounded transverse lines 18 alter the capacitance but do not substantially alter the inductance of stripline 16. Accordingly, by maintaining the inductance while altering the capacitance of stripline 16, the delay along stripline 16 is effectively altered as evident by Equation II. Since the inversely proportional relationship of capacitance and inductance is broken by grounding at least one transverse line 18, the positioning and geometry of stripline 16 and transverse lines 18 comes into play in determining propagation delay along stripline 16.

With this in mind, when at least one transverse line is grounded, Equation I based on the permeability and permittivity of insulating substrate 20 generally no longer holds true. In particular, Equation I is based upon stripline 16 being placed between solid references planes rather than the slotted reference plane created by grounding transverse lines 18. As such, following initial manufacture of delay circuit 10, connectors 40 are added as needed to ground individual transverse lines 18 to tune or adjust the propagation delay of stripline 16 to a desired time (e.g., a time matching other clock signals). In one embodiment, each transverse line 18 that is grounded increases the capacitance and, therefore, increases the propagation delay along stripline 16. Accordingly, the propagation delay of stripline 16 when transverse lines 18 are grounded depends upon the geometry and positioning of stripline 16 and transverse lines 18.

For example, when transverse lines 18 are not grounded or, in other words, are transparent, the capacitance C along stripline 16 is generally expressed by the following Equation III:

$$C = C_o \frac{a}{x} \qquad \text{Equation III}$$

where $C_o$=initial capacitance of the stripline material a=cross-sectional area of the stripline (i.e., T×W)

x=distance between the stripline and the ground plane

Assuming an example in which stripline 16 is centered between ground planes 12 and 14 and, therefore, $h_1=h_2=h$, Equation III becomes the following Equation IV:

$$C_1 = C_o \frac{a}{h} \qquad \text{Equation IV}$$

where $C_1$=capacitance of the stripline material when stripline 16 is centered between ground planes h=distance between stripline 16 and first or second ground plane 12 or 14

As described above, when transverse lines 18 are grounded the capacitance of stripline 16 generally increases. Therefore, assuming each of transverse lines 18 has a similar cross-sectional area and are each spaced a distance equal to the width of each transverse line 18, the increased capacitance upon grounding of transverse lines 18 is expressed by Equation V:

$$C_2 = C_1 + C_o \frac{a_2}{x_2} \qquad \text{Equation V}$$

where $C_2$=capacitance of the stripline material when transverse lines 18 are grounded $a_2$=cross-sectional area of each of the transverse lines $x_2$=distance between the stripline and the transverse lines In an example in which the area of the aggregate of all transverse lines 18 is half the area of reference plane 14, this equation is ultimately arranged as Equation VI:

$$C_2 = C_1\left(1 + \frac{h}{2y}\right) \qquad \text{Equation VI}$$

where y=distance between stripline 16 and transverse lines 18 or since inductance is not changing and in view of Equation II above, the relationship is expressed as Equation VII:

$$\frac{t_{p2}}{t_{p1}} = \sqrt{1 + \frac{h}{2y}} \qquad \text{Equation VII}$$

where $t_{p1}$=propagation delay characteristic of the stripline with translucent transverse lines $t_{p2}$=propagation delay characteristic of the stripline with grounded transverse lines Accordingly, the ratio of the distance between stripline 16 and ground plane 12 or 14 to the distance between stripline 16 and transverse lines 18 (i.e., h/y) determines the amount of propagation delay change created by grounding transverse lines 18 as illustrated in the examples provided in the below Table I.

TABLE I

| h/y | $t_{p2}/t_{p1}$ |
|---|---|
| 6 | 2 |
| 4 | $\sqrt{3}$ |
| 2 | $\sqrt{2}$ |

As such, where h/y is equal to 6, when transverse lines 18 are grounded as described for this example, the propagation delay of stripline 16 is doubled. In other embodiments, different numbers of transverse lines 18 at are grounded altering the spacing of the grounded transverse lines 18 and affecting the propagation delay in a way which is different than that expressed by the above equations and related discussion. Similar changes to the propagation delay characteristics expressed by the above equations would be effectuated when striplines 16 and/or transverse lines 18 have different geometries or spacing within delay line circuit 10 as compared to those values assumed above.

In addition, the tunable nature of stripline 16 within embodiments of delay line system 10 allows the total delay time of stripline 16 to be more closely matched or optimized to the desired time than is generally obtainable for typical embedded delay lines based upon design calculations alone. Moreover, the tunable nature of stripline 16 with transverse lines 18 generally can provide for a less expensive product by decreasing or eliminating the iterative manufacturing runs often utilized to optimize delay of typical, embedded, non-adjustable delay lines. Use of embedded delay lines also can provide additional tolerance to a designer than is generally available with use of external or removable delay lines.

Figure 3:
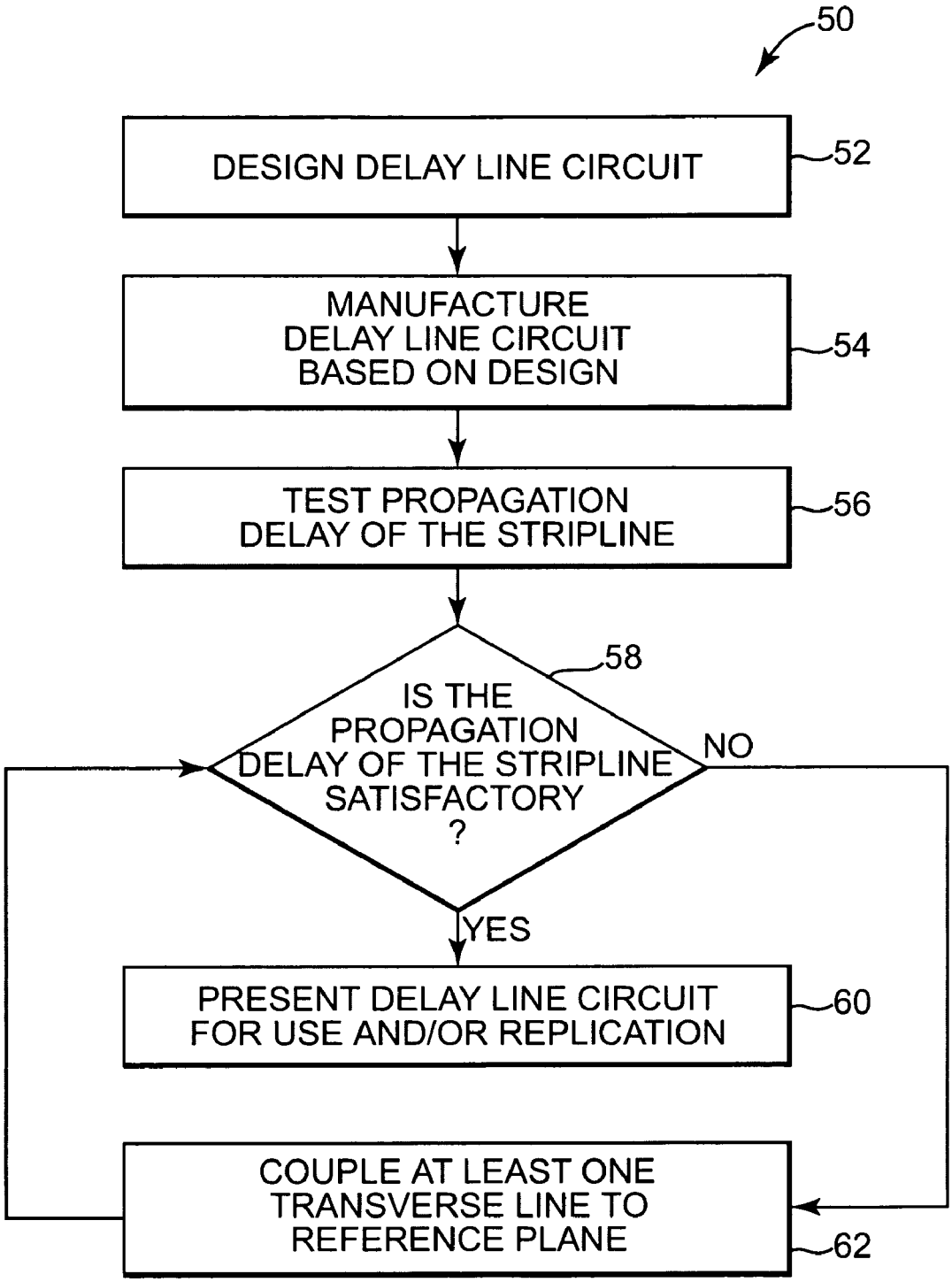
FIG. 3 is a flow chart illustrating one embodiment of a method of providing and utilizing a delay line system.

One embodiment of a method of providing and utilizing delay line system 10 is generally illustrated at 50 in the flow chart of FIG. 3. At 52, a system designer calculates the total propagation delay generally desired along stripline 16 and configures delay line system 10 to have stripline 16 of a length calculated to generally provide the desired total propagation delay based on above Equations I and II.

At 54, based on the design of delay line system 10 provided at 52, delay circuit 10 is manufactured. Although the designer's calculations are configured to provide stripline 16 having the desired propagation delay, variables and manufacturing tolerances usually provide stripline 16 with a delay slightly greater than or less than the total desired propagation delay. Therefore, embodiments of delay line system 10 are provided with transverse lines 18 to permit optimization or tuning of stripline delay after the initial manufacture of delay line system 10.

At 56, following manufacture of delay line system 10, delay line system 10 is tested in a suitable manner to determine the actual delay along stripline 16. At 58, it is determined if the actual propagation delay along stripline 16 is satisfactory. More particularly, the actual propagation delay along stripline 16 is compared with the desired delay and/or an actual clock time or synchronous signal delay to determine whether the difference between the two times is within allowable tolerances for the circuited system including delay line system 10. For example, if the propagation delay along stripline 16 is determined to be too short as compared to the actual desired propagation delay, the propagation delay of the stripline 16 will be increased during tuning.

If the propagation delay is determined to be satisfactory, that is if the propagation delay meets the desired propagation delay of delay line system 10 and is within the tolerances allowed for delay line system 10, then stripline 16 is satisfactory as denoted as "YES" in FIG. 3. Accordingly, at 60, where the propagation delay along stripline 16 is determined to be satisfactory, delay line system 10 is presented for further testing or manufacture of components other than stripline 16, is presented for use in a larger system, and/or is presented for replication (i.e., used as a guide for further manufacture and grounding of a similar number of transverse lines to achieve a similar delay in similar circuits).

Conversely, at 58, if it is determined that the propagation delay of stripline 16 is unsatisfactory as denoted as "NO" in FIG. 3 (i.e., the actual propagation delay along stripline 16 is not within system tolerances as compared to the desired propagation delay), then, at 62, the designer or other delay line system analyst, couples at least one transverse line 18 to the respective reference plane 12 or 14. By coupling transverse line 18 to reference plane 12 or 14 (i.e., by grounding transverse line 18), the capacitance of stripline 16 is increased without substantially altering the inductance of stripline 16, which as described above increases the propagation delay along stripline 16. In one embodiment, depending upon how far the delay along stripline 16 is from being satisfactory, the number of transverse lines 18 to be grounded is estimated and the estimated number of transverse lines 18 are grounded.

Following grounding of a estimated number of transverse lines 18, process elements 58 and 62 are repeated until the actual propagation delay of stripline 16 is considered to be satisfactory. Once considered to be satisfactory, process element 60 is performed as described above. In one embodiment, if too many transverse lines 18 were coupled to a reference plane 12 or 14 at 62, a subsequent process element 62 can also include decoupling of one or more transverse lines 18 from the reference plane 12 or 14. In this iterative process, the propagation delay of stripline 16 is gradually adjusted until it is found to be satisfactory without generally requiring the manufacture of a new circuit system or delay line system 10. As described above, this method allows the propagation delay of stripline 16 to be adjusted without requiring additional manufacturing and without the use of external striplines. In one embodiment, stripline 16 can also be tuned or re-tuned after a period of use to account for changes in the system and/or associated electronic components that occur after use.

Figure 4:
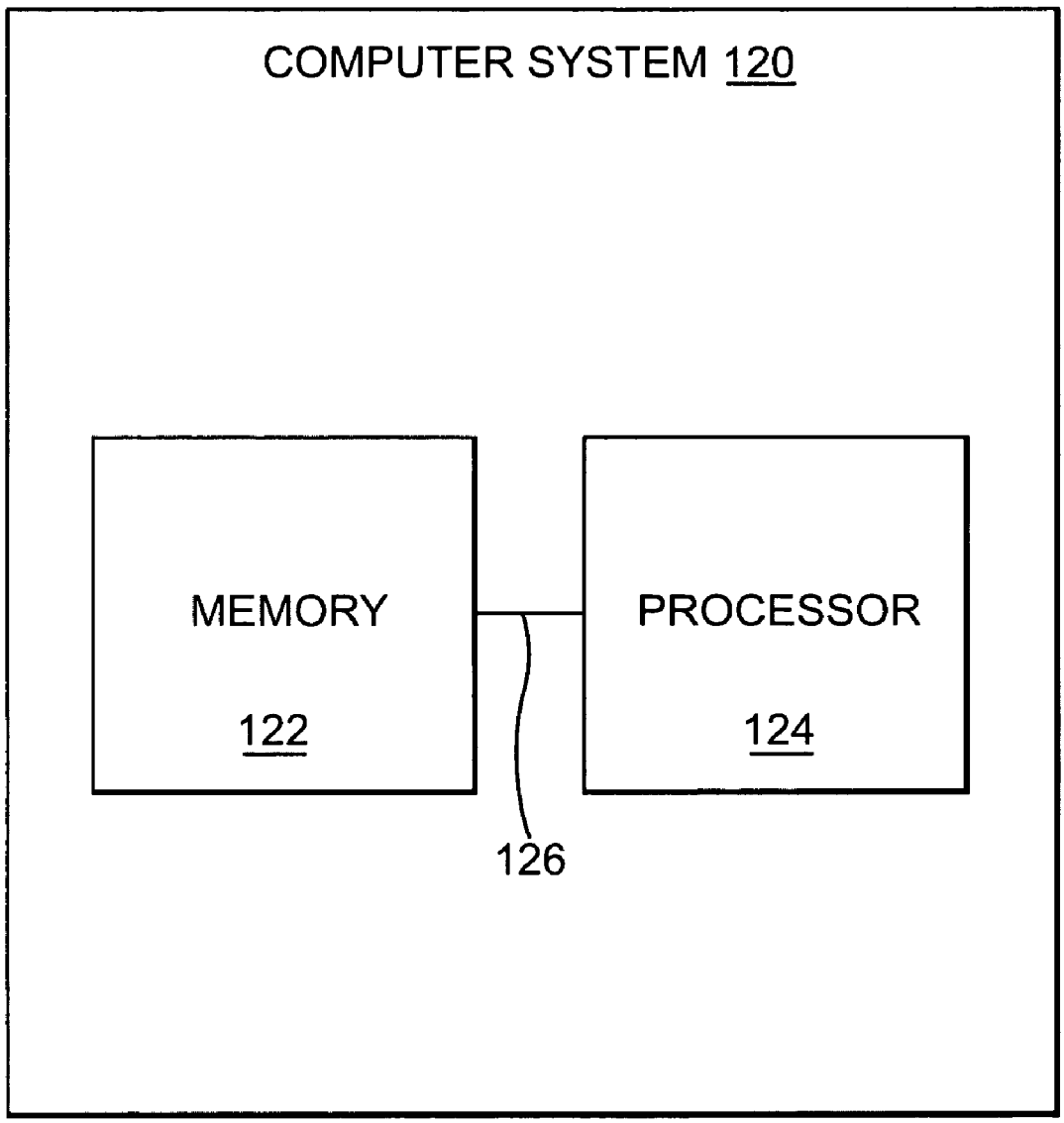
FIG. 4 is a block diagram of one embodiment of a computer system.

In one embodiment, delay line system 10 is part of a computer system, such as computer system 120 generally illustrated in FIG. 4. Computer system 120 may be any type of computer system such as desktop, notebook, mobile, workstation, or server computer. Computer system 120 includes a processor 124 and a memory 122. Processor 124 is coupled to memory 122 at least in part by connector 126 and executes instructions retrieved from memory 122. Memory 122 comprises any type of memory such as RAM (Random Access Memory), SRAM (Static Random Access Memory). DRAM (Dynamic Random Access Memory), SDRAM (Synchronous Dynamic Random Access Memory), and DDR SDRAM (Double-Data Rate Synchronous Dynamic Random Access Memory). In one embodiment, memory 122 includes instructions and data previously loaded to memory 122 from an input device (not shown) such as a hard drive or a CD-ROM. Use of delay line system 10 in electrical systems other than computer system 120 is also contemplated.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A tunable delay line system, comprising:

a stripline defining a propagation delay characteristic;

a plurality of cross-over lines each spaced from and extending with an orientation that is nonparallel with the stripline; and wherein each of the plurality of cross-over lines is configured to be selectively grounded to alter the propagation delay characteristic of the stripline, wherein any of the plurality of cross-over lines that are not selectively grounded are substantially electrically transparent to the stripline.

2. The tunable delay line system of claim 1, wherein the stripline and the plurality of cross-over lines are each substantially embedded within an insulating substrate.

3. The tunable delay line system of claim 1, wherein the plurality of cross-over lines is a first plurality of cross-over lines spaced in a first direction from the stripline, and the tunable delay line system further comprising:

a second plurality of cross-over lines each spaced from the stripline in a second direction and extending substantially perpendicular to the stripline, wherein the second direction is opposite the first direction, and wherein each of the second plurality of cross-over lines is configured to be selectively grounded to alter the propagation delay characteristic of the stripline.

4. The tunable delay line system of claim 1, wherein the stripline has a geometry which affects the propagation delay characteristic of the stripline.

5. The tunable delay line system of claim 1, wherein at least a portion of the plurality of cross-over lines are selectively grounded to thereby increase the propagation delay characteristic of the stripline.

6. The tunable delay line system of claim 1, wherein a number of the plurality of cross-over lines are selectively grounded to thereby increase the propagation delay characteristic of the strip line, and wherein the number of selectively grounded crossover lines is selected to synchronize a transmission of a first clock signal along the stripline with a second clock signal.

7. The tunable delay line system of claim 1, wherein each of the plurality of cross-over lines extends with an orientation substantially perpendicular to the stripline.

8. The tunable delay line system of claim 1, wherein the plurality of cross-over lines are evenly spaced from one another.

9. A computer system, comprising:

a reference plane;

a stripline spaced from the reference plane and defining a propagation delay characteristic; and a plurality of cross-over lines being positioned between the reference plane and the stripline;

wherein each of the plurality of cross-over lines is configured to be selectively coupled to the reference plane to alter the propagation delay characteristic of the stripline, and wherein any crossover lines not selectively coupled to the reference plane are substantially electrically transparent to the stripline.

10. An electrical system, comprising:

a reference plane;

a stripline spaced from the reference plane and defining a propagation delay characteristic; and a plurality of cross-over lines being positioned between the reference plane and the stripline;

wherein each of the plurality of cross-over lines is configured to be selectively coupled to the reference plane to alter the propagation delay characteristic of the stripline, wherein any cross-over lines not selectively coupled to the reference plane are substantially electrically transparent to the stripline, and wherein the reference plane, the stripline, and the plurality of cross-over lines are each substantially embedded within an insulating substrate.

11. The electrical system of claim 10, wherein each of the plurality of cross-over lines extends substantially perpendicularly relative to the stripline.

12. The electrical system of claim 10, wherein the reference plane is a first reference plane, the system further comprising:

a second reference plane spaced from the first reference plane, wherein the stripline extends between the first reference plane and the second reference plane.

13. The electrical system of claim 12, wherein the plurality of cross-over lines is a first plurality of cross-over lines, the electrical system further comprising:

a second plurality of cross-over lines each extending substantially perpendicular to the stripline between the second reference plane and the stripline, wherein each of the second plurality of cross-over lines is configured to be selectively coupled to the second reference plane to alter the propagation delay characteristic of the stripline.

14. The electrical system of claim 12, wherein the stripline is centered between the first reference plane and the second reference plane.

15. The electrical system of claim 10, wherein the position of the stripline with respect to the reference plane affects the propagation delay characteristic of the stripline.

16. The electrical system of claim 10, wherein at least a portion of the plurality of cross-over lines are selectively coupled to the reference plane to thereby increase the propagation delay characteristic of the stripline.

17. The electrical system of claim 10, wherein the reference plane includes a ground plane.

18. A method of tuning a delay line in a delay line system including a plurality of transverse lines spaced from the delay line, the method comprising:

determining the actual propagation delay time along the delay line;

comparing the actual propagation delay time to a desired propagation delay time to determine if the actual propagation delay time is satisfactory or unsatisfactory; and grounding at least one of the plurality of transverse lines to adjust the actual propagation delay time along the delay line if the actual propagation delay time was determined to be unsatisfactory.

19. The method of claim 18, wherein the delay line system includes a ground plane, and further wherein grounding the at least one of the plurality of transverse lines includes selectively coupling the at least one of the plurality of transverse lines to the ground plane.

20. The method of claim 18, wherein the delay line system includes a first ground plane and a second ground plane, and further wherein grounding the at least one of the plurality of transverse lines includes selectively coupling the at least one of the plurality of transverse lines to at least one of the first ground plane and the second ground plane.

21. The method of claim 18, wherein comparing the actual propagation delay time to a desired propagation delay time includes determining if the actual propagation delay time differs from the desired propagation delay time within tolerances for the delay line system.

22. A delay line system, comprising:

means for transmitting a signal on a delayed basis, the means for transmitting defining a propagation delay characteristic and defining a capacitance;

means for selectively varying the propagation delay characteristic of the means for transmitting, wherein the means for selectively varying the propagation delay characteristic includes:

means for conducting, and means for selectively grounding the means for conducting to thereby selectively varying the capacitance; and means for insulating the means for transmitting and the means for selectively varying.

23. The delay line system of claim 22, wherein the means for selectively grounding varies the capacitance while substantially maintaining an inductance of the means for transmitting.

24. The delay line system of claim 22, wherein the means for selectively varying the propagation delay characteristic includes means for providing a slotted ground plane.

25. A method of delaying signal transmission over a transmission line, the method comprising:

manufacturing a delay line system including:

providing a transmission line, and positioning a plurality of cross-over lines spaced from the transmission line; and grounding one or more of the plurality of cross-over lines to adjust an actual propagation delay along the transmission line to substantially equal a desired propagation delay, wherein grounding one or more of the plurality of cross-over lines is performed after manufacturing the delay line system.

26. The method of claim 25, wherein manufacturing a delay line system further includes:

providing a ground plane, wherein grounding one or more of the plurality of cross-over lines includes coupling one or more of the plurality of transmission lines to the ground plane.

27. The method of claim 26, wherein the ground plane is a first ground plane, and the plurality of cross-over lines is a first plurality of cross traces, and further wherein manufacturing a delay line system further includes:

providing a second ground plane spaced from the transmission line, and positioning a second plurality of cross-over lines between the transmission line and the second reference plane.

28. The method of claim 27, further comprising:

grounding one or more of the second plurality of cross-over lines by selectively coupling one or more of the second plurality of cross-over lines to the second ground plane to adjust propagation delay along the transmission line.

29. The method of claim 25, further comprising:

calculating a length of the transmission line to theoretically form the transmission line having the desired propagation delay.

30. The method of claim 25, further including:

testing the delay line system to determine the actual propagation delay along the transmission line;

wherein grounding one or more of the plurality of cross-over lines only occurs if the actual propagation delay does not equal the desired propagation delay.

* * * * *

UNITED STATES PATENT AND TRADEMARK OFFICE

CERTIFICATE OF CORRECTION

PATENT NO. : 7,332,983 B2
APPLICATION NO. : 11/263339
DATED : February 19, 2008
INVENTOR(S) : Thane Michael Larson It is certified that error appears in the above-identified patent and that said Letters Patent is hereby corrected as shown below:

Column 9, line 30, in Claim 9, delete “crossover” and insert -- cross-over --, therefor.

Signed and Sealed this

Twenty-fourth Day of June, 2008

JON W. DUDAS
*Director of the United States Patent and Trademark Office*